United States Patent [19]

Nelle

[11] 4,260,974

[45] Apr. 7, 1981

[54] DEFLECTION UNIT FOR A CATHODE-RAY TUBE

[75] Inventor: Friedrich Nelle, Straubing, Fed. Rep. of Germany

[73] Assignee: International Standard Electric Corporation, New York, N.Y.

[21] Appl. No.: 10,874

[22] Filed: Feb. 9, 1979

[30] Foreign Application Priority Data

Feb. 24, 1978 [DE] Fed. Rep. of Germany ..... 2807978

[51] Int. Cl.[3] ..... H01F 7/00

[52] U.S. Cl. ..... 335/213; 335/210

[58] Field of Search ..... 335/213, 210

[56] References Cited

U.S. PATENT DOCUMENTS 3,895,329 7/1975 Logan et al. ..... 335/213

4,065,738 12/1977 Elders et al. ..... 335/213

4,117,432 9/1978 Shizu ..... 335/213

*Primary Examiner*—Harold Broome

*Attorney, Agent, or Firm*—John T. O'Halloran; Robert A. Walsh

[57] ABSTRACT

In cathode-ray tubes which require a precise specific electromagnetic deflection field configuration as for example, in self-converging color television picture tubes, an accurate distribution of the coil windings has to be maintained on the inside of the deflection unit. In practice, this requirement has been met with the aid of toroidal coil windings, but with respect to the more sensitive saddle-type coils this problem has not yet been solved satisfactorily, especially when large numbers of winding turns are to be accommodated. With respect to saddle-type coils the invention proposes to solve this problem by placing the windings into grooves.

5 Claims, 4 Drawing Figures

DEFLECTION UNIT FOR A CATHODE-RAY TUBE

BACKGROUND OF THE INVENTION

The present invention relates to a deflection unit (yoke) for a cathode-ray tube, which is arranged toroidally around the neck of the tube and opens up in a trumpet-like manner towards the screen, and produces an electro-magnetic field for deflecting one or more electron beams, and in which, at least in one direction of displacement, the deflecting field is produced by a set of saddle-type coils, the windings of which are wound on to a coil form on the face sides and on the inner surface of the deflection unit.

With respect to deflection units, it is a general requirement to achieve the necessary field pattern by way of the physical configuration of the deflection coils.

The required accuracy of the field pattern to be formed is particularly high in the case of deflection units which, owing to the shape of the picture tube, open up in a trumpet-like manner, especially in the case of color television picture tubes having high deflection angles.

Such high requirements can be met approximately by employing, for example, toroidal coils.

In the case of saddle-type coils having the advantage of a higher sensitivity over the toroidal coils, this has far less been able to achieve up to now owing to the more difficult geometry and for reasons of the difficulties in manufacture resulting therefrom, especially when a high impedance and, consequently, a large number of turns is required for circuit-technical reasons.

From the German Published Patent Application (DT-OS) Nos. 26 01 205 and 26 30 297, a deflection unit with saddle-type coils has become known, the windings of which are guided on the face sides of the yoke in grooves, with a possibility of providing further points of support on the inside surface of the yoke.

A similar point-wise fixing of the winding turns is also found in an example of embodiment relating to a deflection unit with saddle-type coils as disclosed in the German Printed Patent Application (DT-AS) No. 26 15 126. The guiding of the winding turns on the inside of the yoke by way of axial grooves in the core material is disclosed in the German Petty Patent (DT-GM) No. 74 41 864.

SUMMARY OF THE INVENTION

It is the object of the invention to provide a deflection unit of the type mentioned hereinbefore, which permits the formation of a desired field pattern and which, at the same time, enables an exact fixing of the coil windings also in the case of a large number of turns, without having to modify the contours of the core.

According to the present invention, each of two halves of a saddle-type coil is arranged on one half of a coil form consisting of two parts, with grooves determining the coil winding distribution being provided for in the surface of the coil form facing the tube wall.

As an advantage over the conventional arrangements, practice has shown that by applying the solution according to the invention, e.g. to shadow-mask type color television picture tubes having several electron beams, besides the adjustment of the deflection unit on the neck of the tube, there are not required any further means for achieving the desired convergence, and that this convergence behavior is also reproducible under mass-production requirements. According to another advantage of the invention, it is not so important for the individual wire to assume an exact position in the respective groove, as long as it is safeguarded that the wires are evenly distributed for filling the grooves.

It is also considered to be very advantageous to be able to choose from a large number of easily deformable materials, such as the injection-moldable thermoplast or the thermally deformable plastic foil, for manufacturing the coil form. This coil form does not need to consist of the same material as the toroidal core which is difficult to process and to form.

According to one advantageous further embodiment of the invention, it is proposed to design the groove cross-section also for a different occupation by wires, in such a way that the inserted wire or that the inserted wires will almost completely fill out the grooves, thus further increasing the accuracy of the winding distribution.

Moreover, it is proposed to arrange grooves also in planes other than those in which the tube axis is lying, or else to design the grooves to have a bent or curved form. In this way, it is possible to take more influence upon the pattern of the deflecting field than was possible with the hitherto conventional solutions.

As another advantageous further embodiment of the invention, it is also possible to arrange several coil sets, for example, for several directions of displacement, into one another as will still be described more precisely hereinafter with reference to an example of embodiment.

BRIEF DESCRIPTION OF THE FIGURES

Further details of the invention will now be explained in greater detail with reference to FIGS. 1 to 4 of the accompanying drawings, in which.

DETAILED DESCRIPTION OF THE INVENTION

Figure 1:
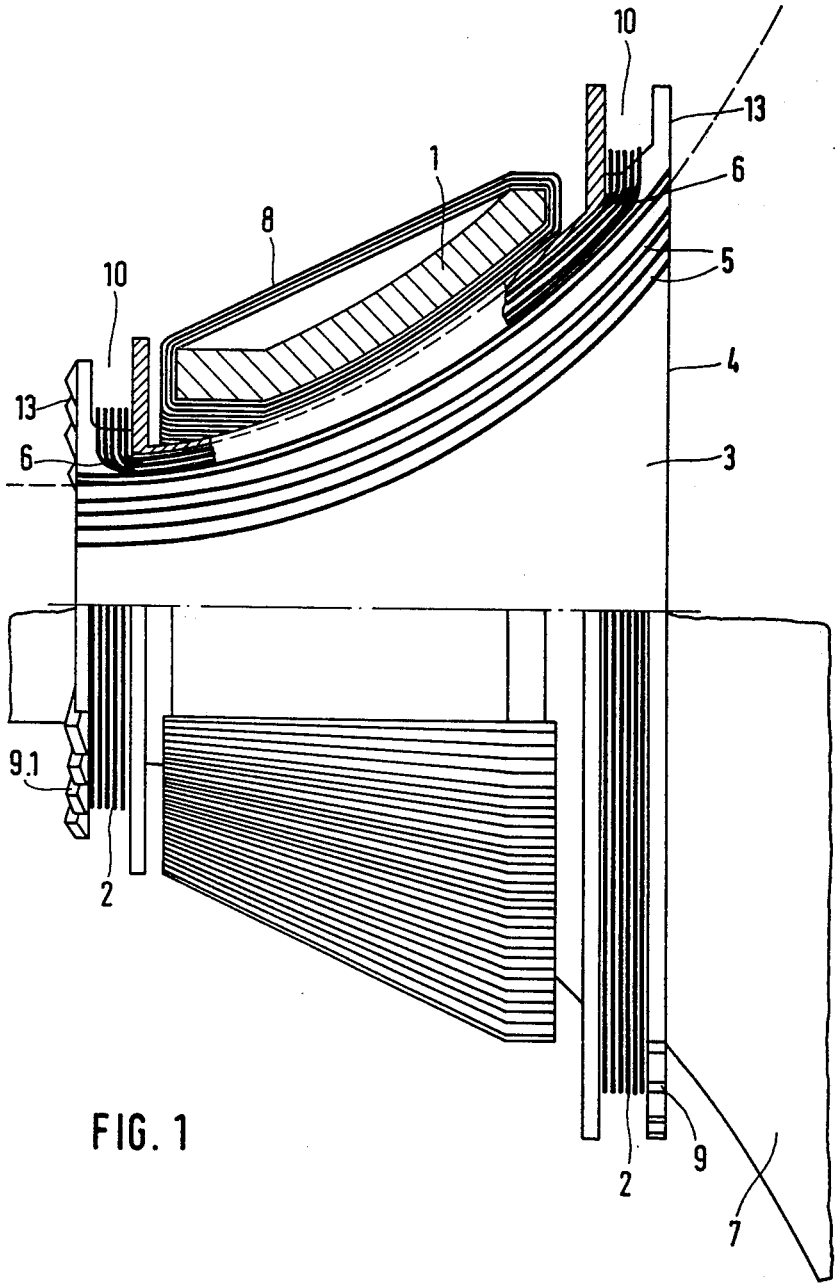
FIG. 1 is a part-sectioned view taken through a schematical example of embodiment of the invention.

FIG. 1 shows an example of embodiment relating to a deflection unit arranged on the neck of the tube (7) and which, apart from the saddle-type coils (2), as an example of a further direction of displacement, still shows toroidal coils (8) which are wound around the toroidal core (1). According to the invention, grooves (5) are arranged in the inner surface (3) of the yoke in the coil form (4). There are various ways of designing these grooves (5). Thus, among others, these grooves may be cornered and provided with flat walls following the shape of the coil form, and equally well it is possible to provide round or hollow grooves. These grooves (5), for example, may be obtained by folding a formable foil. They may be wider than deep, or, conversely, deeper than wide, and the webs forming between them may be narrower than the grooves themselves. Likewise, also parts of the coil form may be removed between the grooves. The turns of the windings (6) during the winding operation are led in a way customary to the person skilled in the art, by coming from a groove (5) through the slots (9) into the external groove (10) in which they are led until entering the next groove (5). Preferably, the grooves (5) are almost completely filled with the winding turns (6).

Moreover, and in accordance with an advantageous further embodiment of the invention, FIG. 1 shows slots (9.1) to be provided for in the external groove (10), with the one side thereof protruding from the face side (13). In order to achieve this, the webs between the slots in this example of embodiment are arranged slantingly with respect to a plane extending vertically in relation to the tube axis. In this way the guiding of the wire is substantially improved during the operation of winding the coils, thus enabling a quicker and more reliable winding operation.

Figure 2:
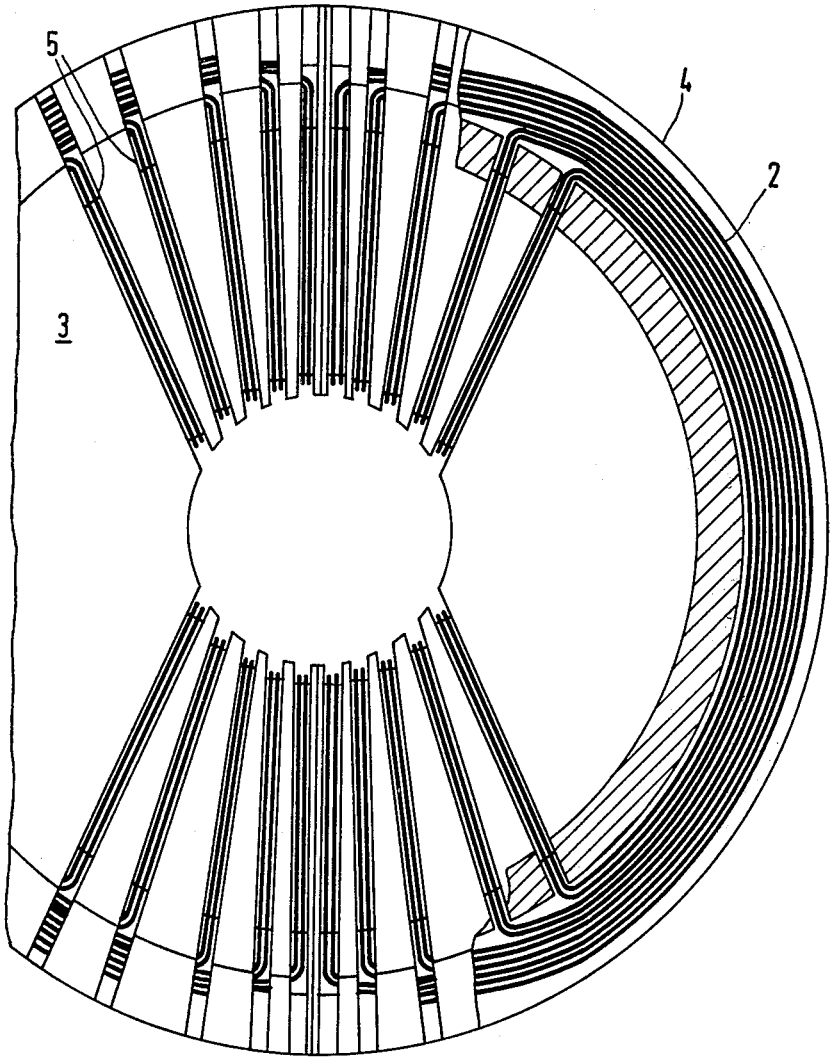
FIGS. 2 and 3 show views of the face sides of a coil form according to the invention with part-sectioned views and winding examples.
Figure 3:
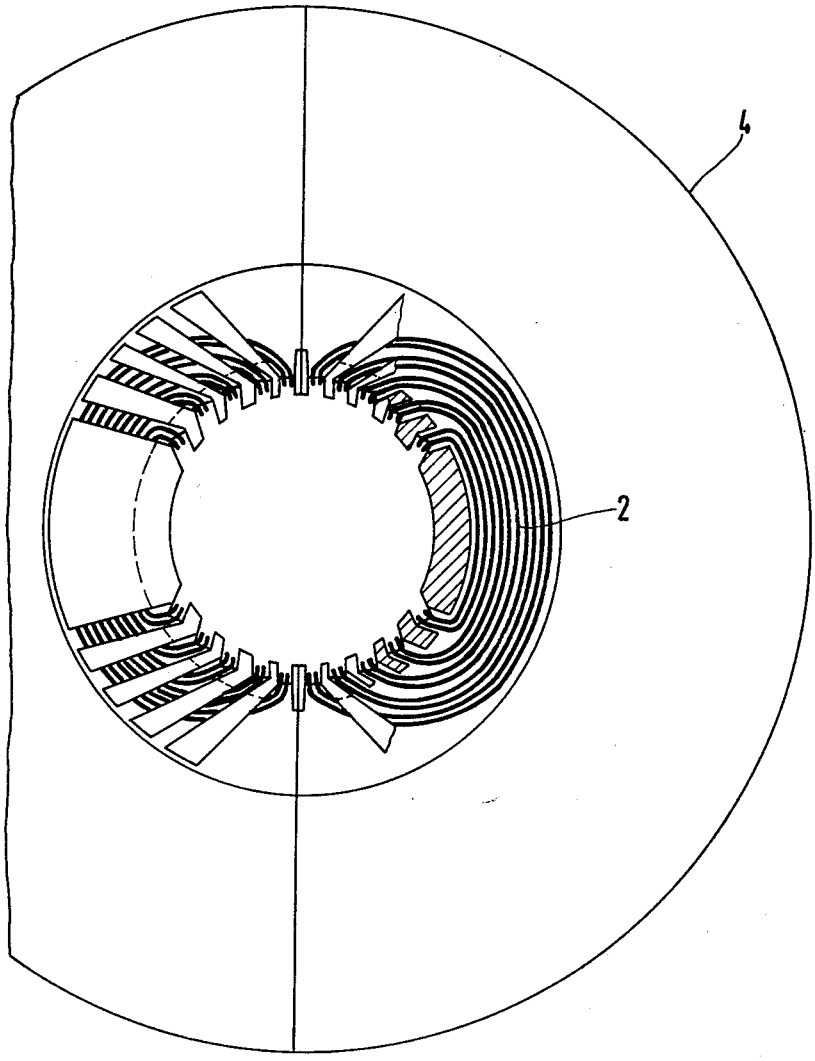

FIGS. 2 and 3 show a coil form according to FIG. 1 with a view on to the two face sides. Wire winding example are shown and become more clearly evident from the part-sectioned views on the coil form as regards the direction of the wire turns. As is shown in FIG. 2, the grooves (5) are provided in this case to have straight side walls, with the planes thereof extending parallel in relation to the tube axis in order thus to be able to make the tools, e.g. for a manufacture in accordance with the injection molding process, as well as the device for winding the coils (2), as simple as possible. By distributing the grooves (5) on the inner surface (3) of the coil form (4), as well as by them deviating from the radial direction, it is possible to take influence upon the configuration of the deflecting field, in order to achieve, for example, a field distribution as disclosed in the German Published Patent Application (DT-OS) No. 24 11 084 for color television picture tubes. But also grooves (5) in other planes are possible. The grooves (5) may also have a bent or curved design, as already mentioned hereinbefore.

Figure 4:
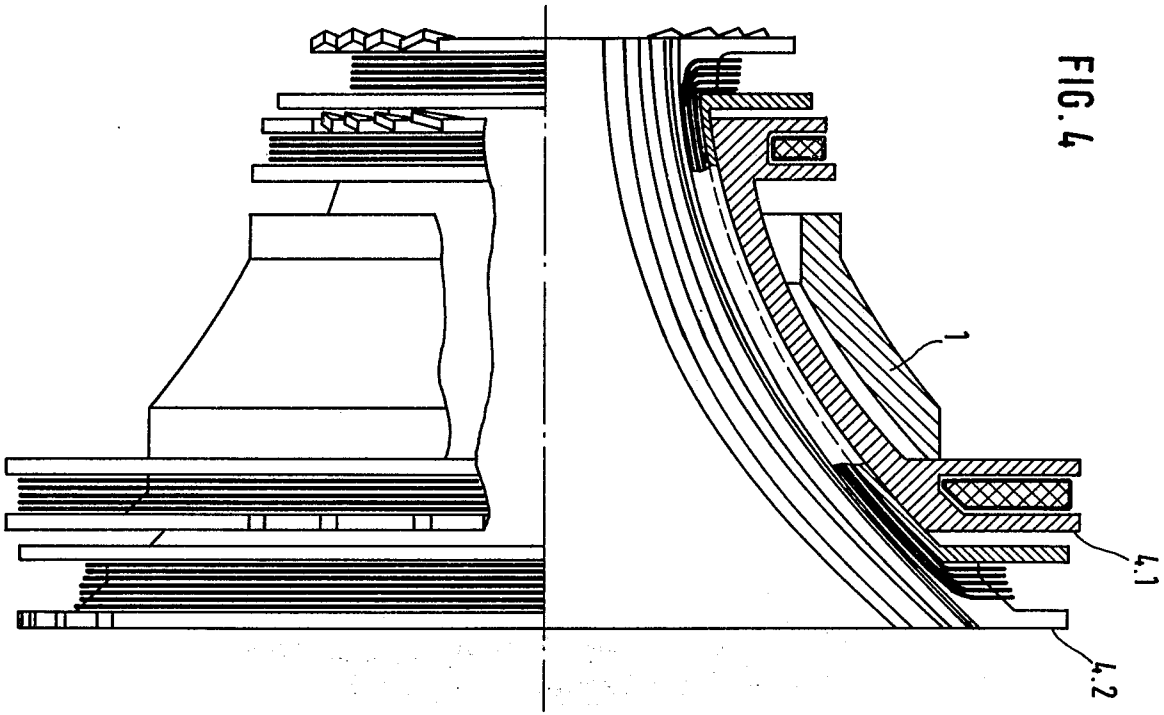
FIG. 4 is the schematical part-sectioned view taken through an example of embodiment comprising two sets of coils arranged into one another.

FIG. 4 shows a second example of embodiment of the invention. According to a further embodiment of the invention, two coil forms (4.1, 4.2) are arranged into one another in this case, in order thus to produce deflecting fields for displacing electrons in two directions. Relative thereto, for example, it is also within the scope of the invention to produce the coil form (4.1) by being injection-molded on to the core (1).

I claim:

1. A deflection unit for a cathode-ray tube, which is arranged toroidally around the neck of the tube and opens up in a trumpet-like manner towards the screen, and produces an electromagnetic field for deflecting one or more electron beams, and in which, at least in one direction of displacement, the deflecting field is produced by a set of saddle-type coils, the windings of which are wound on to a coil form on the face sides and on the inner surface of the deflection unit, wherein the improvement comprises;

each of the two halves of the saddle-type coil is arranged on one half of a coil form comprising two parts, with grooves determining the exact coil winding distribution being provided for in the surface of the coil form facing the tube wall;

the groove cross-sections are so designed that said grooves are almost completely filled with wires; and at least some of said grooves deviate in their direction from the planes of the tube axis.

2. Deflection unit of claim 1, wherein one coil form for the coils of a first direction of displacement, and a further coil form for the coils of a second direction of displacement, are arranged in such a way into one another that the trumpet-like portions of the coil forms will come to lie almost completely on one another.

3. Deflection unit of claims 1 or 2 wherein the coil form is produced by being injection-molded on to the toroidal core.

4. Deflection unit of claims 1 or 2, wherein the wires on the face sides are guided in external grooves, and that at the slots formed as a continuation of the grooves on the face sides, the one side of the slots towards which the wires are turned out of the groove and into the external groove protrudes either from one of the face sides or from both.

5. Deflection unit of claim 4, wherein the web between the slots is arranged slantingly with respect to a plane extending vertically in relation to the tube axis.

* * * * *